US009141056B2

(12) United States Patent
Yamamoto

(10) Patent No.: US 9,141,056 B2
(45) Date of Patent: Sep. 22, 2015

(54) FIXING DEVICE AND IMAGE FORMING APPARATUS INCORPORATING SAME

(71) Applicant: Shin Yamamoto, Osaka (JP)

(72) Inventor: Shin Yamamoto, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 79 days.

(21) Appl. No.: 13/865,533

(22) Filed: Apr. 18, 2013

(65) Prior Publication Data

US 2013/0336686 A1 Dec. 19, 2013

(30) Foreign Application Priority Data

Jun. 18, 2012 (JP) ..... 2012-136931

(51) Int. Cl.
*G03G 15/20* (2006.01)

(52) U.S. Cl.
CPC ..... *G03G 15/2085* (2013.01); *G03G 15/2028* (2013.01); *G03G 2215/0132* (2013.01)

(58) Field of Classification Search
CPC ..... G03G 15/2028; G03G 15/2085; G03G 2215/0132
USPC ..... 399/323
See application file for complete search history.

(56) References Cited

U.S. PATENT DOCUMENTS 3,991,999 A * 11/1976 Brooke ..... 271/308
4,475,804 A * 10/1984 Kanno et al. ..... 399/323
5,053,830 A * 10/1991 Arai ..... 399/323
5,802,434 A * 9/1998 Takehara et al. ..... 399/323
2002/0037186 A1* 3/2002 Tanaka ..... 399/322
2002/0164172 A1* 11/2002 Tsubaki et al. ..... 399/45
2004/0151521 A1* 8/2004 Rasch et al. ..... 399/323
2004/0223794 A1* 11/2004 Tomatsu ..... 399/323
2005/0276638 A1* 12/2005 Yamada ..... 399/323
2007/0048036 A1* 3/2007 Kanematsu et al. ..... 399/323
2007/0140752 A1 6/2007 Yamamoto et al.
2007/0172278 A1 7/2007 Yamamoto
2008/0013993 A1 1/2008 Obata et al.
2008/0056783 A1 3/2008 Yamamoto et al.
2008/0193162 A1 8/2008 Yamazoe et al.
2009/0110418 A1 4/2009 Ogiso et al.
2009/0290893 A1 11/2009 Ogiso et al.
2009/0297233 A1* 12/2009 Kameda ..... 399/322
2010/0054785 A1 3/2010 Ogiso et al.
2010/0232848 A1* 9/2010 Naitoh ..... 399/323

(Continued)

FOREIGN PATENT DOCUMENTS

JP 2004-061854 2/2004
JP 2010-217442 9/2010
JP 2011-048351 3/2011

*Primary Examiner* — David Bolduc
(74) *Attorney, Agent, or Firm* — Oblon, McClelland, Maier & Neustadt, L.L.P.

(57) ABSTRACT

A fixing device includes a plurality of separation assemblies disposed opposite a fixing rotary body to separate a recording medium from the fixing rotary body. Each separation assembly includes a separator separatably contacting the fixing rotary body, a contact biasing member anchored to the separator to bias the separator against the fixing rotary body, an arm separatably contacting the separator to isolate the separator from the fixing rotary body, and an actuator connected to the arm to separate the arm from the separator. A controller is operatively connected to the actuator of each separation assembly to control the actuator of at least one of the plurality of separation assemblies to separate the arm from the separator so as to bring the separator into contact with the fixing rotary body by the contact biasing member.

20 Claims, 8 Drawing Sheets

(56) References Cited

U.S. PATENT DOCUMENTS

| | | | | |
|---|---|---|---|---|
| 2011/0026944 | A1* | 2/2011 | Naitoh | 399/21 |
| 2011/0076068 | A1* | 3/2011 | Kunugi | 399/323 |
| 2012/0020681 | A1 | 1/2012 | Naitoh et al. | |
| 2012/0020690 | A1 | 1/2012 | Yamamoto et al. | |
| 2012/0195652 | A1* | 8/2012 | Takahashi et al. | 399/323 |
| 2013/0004213 | A1* | 1/2013 | Takahashi | 399/323 |
| 2013/0004214 | A1* | 1/2013 | Sakaya et al. | 399/323 |

* cited by examiner

FIXING DEVICE AND IMAGE FORMING APPARATUS INCORPORATING SAME

CROSS-REFERENCE TO RELATED APPLICATION

This patent application is based on and claims priority pursuant to 35 U.S.C. §119 to Japanese Patent Application No. 2012-136931, filed on Jun. 18, 2012, in the Japanese Patent Office, the entire disclosure of which is hereby incorporated by reference herein.

BACKGROUND OF THE INVENTION

1. Field of the Invention

Exemplary aspects of the present invention relate to a fixing device and an image forming apparatus, and more particularly, to a fixing device for fixing an image on a recording medium and an image forming apparatus incorporating the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing roller heated by a heater and a pressing roller pressed against the fixing roller to form a fixing nip therebetween through which a recording medium bearing a toner image is conveyed. As the recording medium passes through the fixing nip, the fixing roller and the pressing roller apply heat and pressure to the recording medium, thus melting and fixing the toner image on the recording medium.

Since the toner image on the recording medium faces the fixing roller, as the recording medium bearing the toner image is discharged from the fixing nip, the recording medium may adhere to the fixing roller by an adhesive force of melted toner of the toner image on the recording medium. To address this problem, a separation pawl disposed downstream from the fixing nip in a recording medium conveyance direction may contact the fixing roller to separate the recording medium from the fixing roller and at the same time guide the recording medium to the outside of the fixing device.

However, since the separation pawl is in constant contact with the fixing roller, the separation pawl may produce abrasion marks on the fixing roller as its useful life is about to end. Accordingly, as a recording medium bearing a relatively large, solid toner image slides over the fixing roller, the abrasion marks on the fixing roller may scratch the solid toner image, producing gloss streaks or variation in gloss on the solid toner image.

To address this problem, the separation pawl may be isolated from the fixing roller while no recording medium is conveyed through the fixing nip. However, if a plurality of layered recording media is accidentally conveyed through the fixing nip or a recording medium is jammed at the fixing nip, the recording medium may enter between the separation pawl and the fixing roller and may be wound around the fixing roller.

On the other hand, the separation pawl may be sandwiched between separation pawl protectors that rotatably support a guide roller to prevent the separation pawl from scratching the toner image on the recording medium. For example, the guide roller projects farther than the separation pawl and the separation pawl protectors toward a conveyance path through which the recording medium is conveyed, thus contacting and guiding the recording medium conveyed through the conveyance path to the outside of the fixing device. Hence, the guide roller prevents the separation pawl from scratching the toner image on the recording medium, thus suppressing resultant gloss streaks.

However, if a rigid recording medium is conveyed through the conveyance path, the rigid recording medium may slide over the guide roller with increased friction therebetween. Additionally, immediately after the recording medium is discharged from the fixing nip, the toner image is not cooled and fixed on the recording medium sufficiently. Accordingly, the toner image may be scratched and damaged by the guide roller.

SUMMARY OF THE INVENTION

This specification describes below an improved fixing device. In one exemplary embodiment of the present invention, the fixing device includes a fixing rotary body rotatable in a predetermined direction of rotation and a pressing rotary body contacting the fixing rotary body to form a fixing nip therebetween through which a recording medium is conveyed. A plurality of separation assemblies is disposed opposite an outer circumferential surface of the fixing rotary body and aligned in an axial direction thereof to separate the recording medium discharged from the fixing nip from the fixing rotary body. Each of the plurality of separation assemblies includes a separator separatably contacting the outer circumferential surface of the fixing rotary body, a contact biasing member anchored to the separator to bias the separator against the fixing rotary body, an arm separatably contacting the separator to isolate the separator from the fixing rotary body, and an actuator connected to the arm to separate the arm from the separator. A controller is operatively connected to the actuator of each of the plurality of separation assemblies to control the actuator of at least one of the plurality of separation assemblies to separate the arm from the separator so as to bring the separator into contact with the fixing rotary body by the contact biasing member.

This specification further describes an improved image forming apparatus. In one exemplary embodiment of the present invention, the image forming apparatus includes the fixing device described above.

BRIEF DESCRIPTION OF THE SEVERAL VIEWS OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
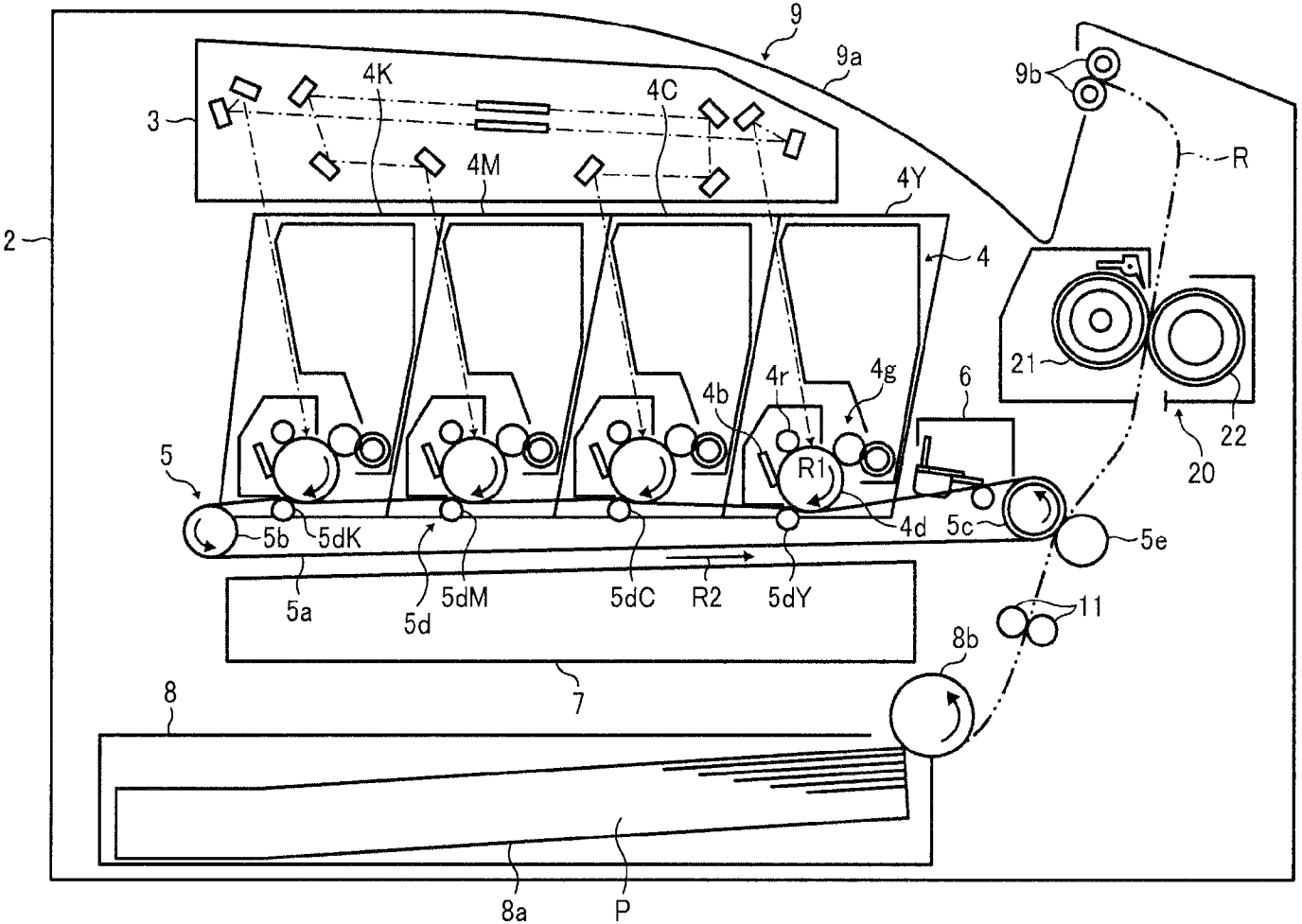
FIG. 1 is a schematic vertical sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic vertical sectional view of the image forming apparatus 1. The image forming apparatus 1 may be a copier, a facsimile machine, a printer, a multifunction printer (MFP) having at least one of copying, printing, scanning, plotter, and facsimile functions, or the like. According to this exemplary embodiment, the image forming apparatus 1 is a color printer that forms color and monochrome toner images on recording media P by electrophotography.

As shown in FIG. 1, the image forming apparatus 1 includes a body 2 accommodating an exposure device 3 located in an upper portion of the body 2; an image forming device 4 situated below the exposure device 3; a transfer device 5 situated below the image forming device 4; a belt cleaner 6 disposed opposite the transfer device 5; a waste toner container 7 situated below the transfer device 5; a sheet supply 8 situated below the waste toner container 7 in a lower portion of the body 2; a registration roller pair 11 interposed between the sheet supply 8 and the transfer device 5; and a fixing device 20 situated above the transfer device 5. The image forming apparatus 1 further includes a sheet output 9 disposed atop the body 2. The body 2 includes a cabinet that accommodates the components described above and a conveyance path R extending from the sheet supply 8 to an output roller pair 9*b* that discharges a recording medium P sent from the sheet supply 8 onto the sheet output 9.

A detailed description is now given of a configuration of the exposure device 3.

The exposure device 3 emits laser beams onto the image forming device 4 according to yellow, cyan, magenta, and black image data constituting color image data sent from an external device such as a client computer, thus forming electrostatic latent images on the image forming device 4.

A detailed description is now given of a configuration of the image forming device 4.

The image forming device 4 is constructed of four process units 4Y, 4C, 4M, and 4K. Taking the process unit 4Y as an example, the process unit 4Y includes a photoconductive drum 4*d*, a charging roller 4*r*, a development device 4*g*, and a cleaning blade 4*b*. It is to be noted that although not shown, the process units 4C, 4M, and 4K also have those components. The process unit 4Y performs a charging process for charging the photoconductive drum 4*d*, an exposure process for forming an electrostatic latent image on the photoconductive drum 4*d*, a developing process for developing the electrostatic latent image into a yellow toner image, a primary transfer process for primarily transferring the yellow toner image onto the transfer device 5, a cleaning process for cleaning the photoconductive drum 4*d*, and a discharging process for discharging the photoconductive drum 4*d*, as described below.

In the charging process, as the photoconductive drum 4*d* rotates in a rotation direction R1, the charging roller 4*r* charges an outer circumferential surface of the photoconductive drum 4*d* to build up static in the photoconductive drum 4*d*. In the exposure process, the exposure device 3 emits a laser beam onto the charged outer circumferential surface of the photoconductive drum 4*d* to form an electrostatic latent image thereon that is made of an electrostatic pattern. In the development process, the development device 4*g* supplies yellow toner to the electrostatic latent image formed on the photoconductive drum 4*d*, thus visualizing the electrostatic latent image into a yellow toner image. In the primary transfer process, the transfer device 5 primarily transfers the yellow toner image onto the transfer device 5. In the cleaning process, the cleaning blade 4*b* removes residual yellow toner failed to be transferred onto the transfer device 5 and therefore remaining on the photoconductive drum 4*d* therefrom. In the discharging process, a discharger removes residual static electricity from the photoconductive drum 4*d* so that the photoconductive drum 4*d* is ready for a next print job.

The photoconductive drum 4*d* includes a photoconductive layer made of an inorganic or organic photoconductor or photoreceptor that constitutes a tubular outer circumferential surface. The charging roller 4*r*, disposed in proximity to the outer circumferential surface of the photoconductive drum 4*d*, charges the photoconductive drum 4*d* by electrostatic discharge therebetween. The development device 4*g* is constructed of a development member that applies yellow toner to the photoconductive drum 4*d* and a supplier that supplies yellow toner to the development member. The cleaning blade 4*b* is constructed of an elastic band made of rubber and a toner remover (e.g., a brush). The development device 4*g* is detachably attached to the body 2. Each of the process units 4C, 4M, and 4K has a configuration similar to that of the process unit 4Y. However, the process units 4C, 4M, and 4K form cyan, magenta, and black toner images, respectively, that are primarily transferred onto the transfer device 5.

A detailed description is now given of a construction of the transfer device 5.

The transfer device 5 includes a transfer belt 5*a*, a driven roller 5*b*, a driving roller 5*c*, a primary transfer roller set 5*d*, and a secondary transfer roller 5*e*. The transfer belt 5*a* is a belt with no end, that is, an endless belt looped over and stretched across the driven roller 5*b* and the driving roller 5*c*. As the driving roller 5*c* drives and rotates the transfer belt 5*a* in a rotation direction R2 by friction therebetween, the rotating transfer belt 5*a* rotates the driven roller 5*b* by friction therebetween.

The primary transfer roller set 5*d* is constructed of four primary transfer rollers 5dY, 5dC, 5dM, and 5dK that press against the four photoconductive drums 4*d* of the four process units 4Y, 4C, 4M, and 4K via the transfer belt 5*a*, thus forming four primary transfer nips between the four photoconductive drums 4*d* and the transfer belt 5*a*, respectively. The primary transfer rollers 5dY, 5dC, 5dM, and 5dK primarily transfer the yellow, cyan, magenta, and black toner images formed on the photoconductive drums 4*d* onto the transfer belt 5*a* rotating in the rotation direction R2 such that the yellow, cyan, magenta, and black toner images are superimposed on a same position on the transfer belt 5*a*. Thus, a color toner image is formed on the transfer belt 5*a*. The secondary transfer roller 5*e* contacting an outer circumferential surface of the transfer belt 5*a* presses against the driving roller 5*c* via the transfer belt 5*a* to form a secondary transfer nip between the secondary transfer roller 5*e* and the transfer belt 5*a*. The secondary transfer roller 5*e* secondarily transfers the color toner image formed on the transfer belt 5*a* onto a recording medium P conveyed from the sheet supply 8.

A detailed description is now given of a configuration of the belt cleaner 6.

The belt cleaner 6 is interposed between the secondary transfer nip and the process unit 4Y in the rotation direction R2 of the transfer belt 5*a*. The belt cleaner 6 is constructed of a toner remover and a toner conveyance tube. The toner remover removes residual waste toner failed to be transferred onto a recording medium P from the transfer belt 5*a* and therefore remaining on the outer circumferential surface of the transfer belt 5*a* therefrom. The toner conveyance tube extends from the toner remover to the waste toner container 7 to convey the waste toner removed from the transfer belt 5*a* to the waste toner container 7.

A detailed description is now given of a configuration of the waste toner container 7.

The waste toner container 7 is situated at a center portion of the body 2 below the transfer device 5. The toner conveyance tube of the belt cleaner 6 is connected to an inlet of the waste toner container 7 through which the waste toner conveyed through the toner conveyance tube is collected into the waste toner container 7.

A detailed description is now given of a configuration of the sheet supply 8.

The sheet supply 8 is situated in the lower portion of the body 2 below the waste toner container 7. The sheet supply 8 is constructed of a sheet tray 8*a* that loads a plurality of recording media P and a feed roller 8*b* that picks up and feeds an uppermost recording medium P from the plurality of recording media P loaded on the sheet tray 8*a* to the conveyance path R.

A detailed description is now given of a configuration of the sheet output 9.

The sheet output 9 is disposed above the exposure device 3 and atop the body 2. The sheet output 9 is constructed of the output roller pair 9*b* and an output tray 9*a*. The recording medium P bearing the color toner image secondarily transferred from the transfer belt 5*a* is conveyed to the fixing device 20 where a fixing roller 21 and a pressing roller 22 apply heat and pressure to the recording medium P to fix the color toner image on the recording medium P. Thereafter, the recording medium P bearing the fixed color toner image is conveyed to the output roller pair 9*b*. As the output roller pair 9*b* feeds the recording medium P conveyed through the conveyance path R onto the output tray 9*a*, the output tray 9*a* receives the recording medium P. Thus, the recording media P are stacked on the output tray 9*a*.

A detailed description is now given of a configuration of the registration roller pair 11.

The registration roller pair 11 controls conveyance of the recording medium P conveyed from the sheet tray 8*a* by the feed roller 8*b* through the conveyance path R. For example, a registration sensor, situated in the conveyance path R at a position between the feed roller 8*b* and the registration roller pair 11, detects a leading edge of the recording medium P. When a predetermined time period elapses after the registration sensor detects the leading edge of the recording medium P, the leading edge of the recording medium P comes into contact with the registration roller pair 11 and is temporarily halted by the registration roller pair 11 that stops its rotation. Thereafter, the registration roller pair 11 resumes its rotation at a predetermined time when the color toner image formed on the transfer belt 5*a* rotating in the rotation direction R2 reaches the secondary transfer nip, thus feeding the recording medium P to the secondary transfer nip.

Figure 2:
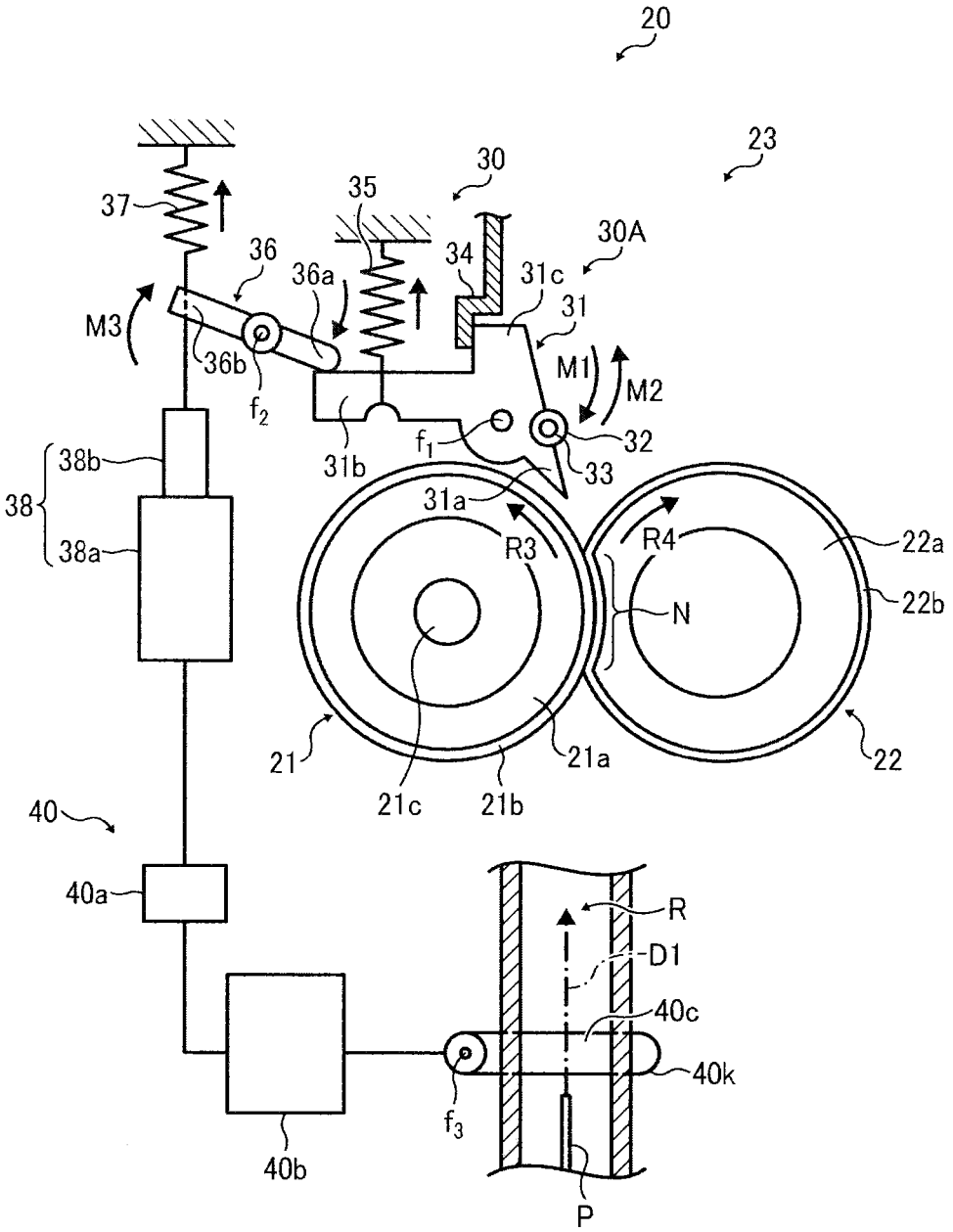
FIG. 2 is a vertical sectional view of a fixing device incorporated in the image forming apparatus shown in FIG. 1 before a recording medium reaches a fixing roller and a pressing roller incorporated therein.
Figure 3:
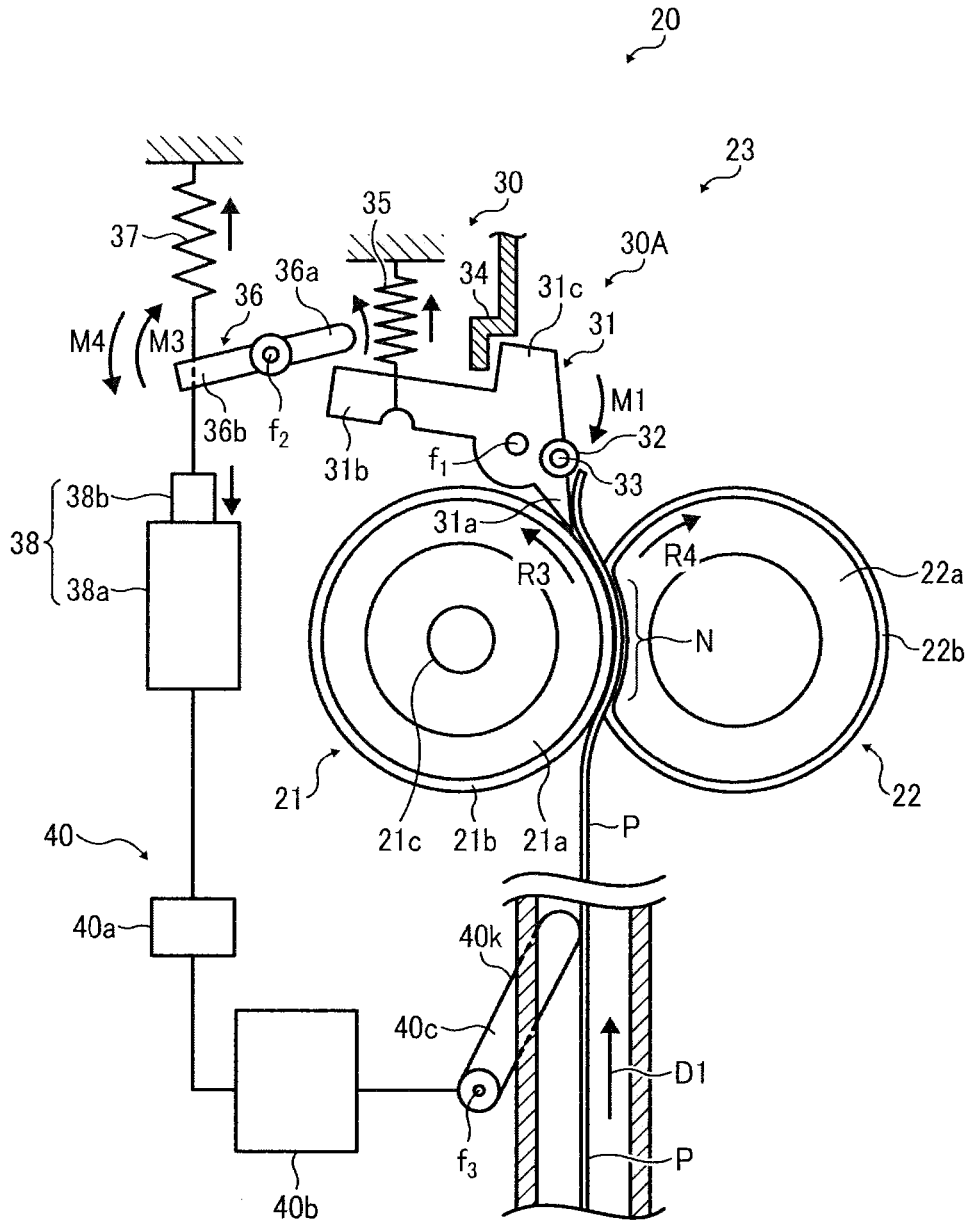
FIG. 3 is a vertical sectional view of the fixing device shown in FIG. 2 when the recording medium is conveyed between the fixing roller and the pressing roller.
Figure 4:
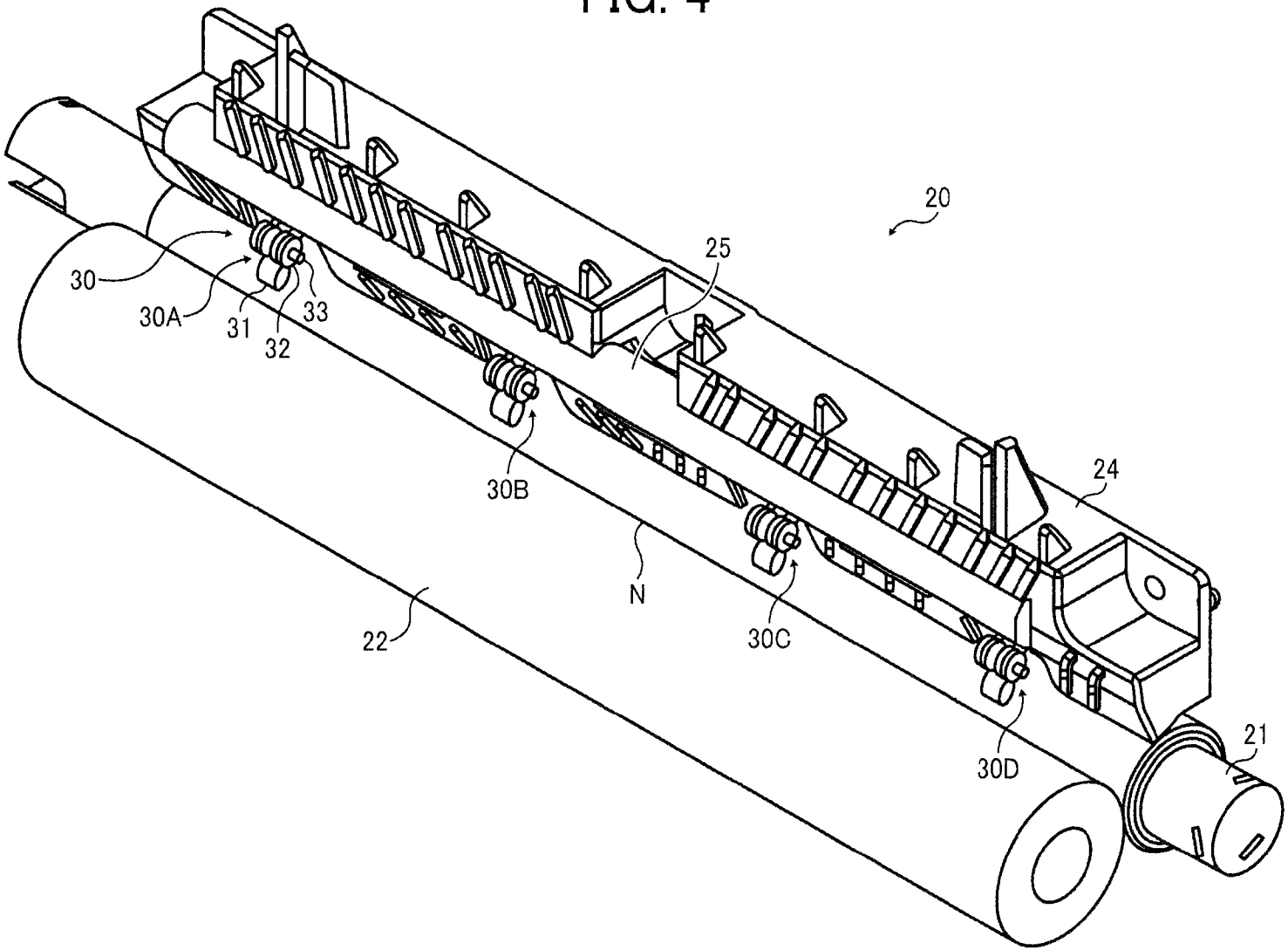
FIG. 4 is a partial perspective view of the fixing device shown in FIG. 2.

With reference to FIGS. 2 to 4, a description is provided of a configuration of the fixing device 20 installed in the image forming apparatus 1 described above.

FIG. 2 is a vertical sectional view of the fixing device 20 before a recording medium P reaches the fixing roller 21 and the pressing roller 22. FIG. 3 is a vertical sectional view of the fixing device 20 when the recording medium P is conveyed between the fixing roller 21 and the pressing roller 22. FIG. 4 is a partial perspective view of the fixing device 20. As shown in FIG. 2, the fixing device 20 (e.g., a fuser) includes the fixing roller 21, the pressing roller 22, and a separation unit 23.

As shown in FIG. 4, the fixing device 20 further includes an exit guide 24 and a guide roller 25. As shown in FIG. 2, the pressing roller 22 is pressed against the fixing roller 21 to form a fixing nip N therebetween. As the recording medium P bearing the toner image is conveyed through the fixing nip N, the fixing roller 21 heated by a heater 21*c* disposed inside the fixing roller 21 and the pressing roller 22 apply heat and pressure to the recording medium P, thus fixing the toner image on the recording medium P. As the recording medium P bearing the fixed toner image is discharged from the fixing nip N, the separation unit 23, disposed downstream from the fixing nip N in a recording medium conveyance direction D1, separates the recording medium P from the fixing roller 21. As shown in FIG. 4, the guide roller 25 and the exit guide 24 are disposed downstream from the fixing nip N in the recording medium conveyance direction D1. The guide roller 25 and the exit guide 24 feed and guide the recording medium P separated by the separation unit 23 toward the output roller pair 9*b* depicted in FIG. 1.

A detailed description is now given of a construction of the fixing roller 21.

As shown in FIG. 2, the fixing roller 21, serving as a fixing rotary body, is constructed of a roll 21*a* and an outer layer 21*b* coating an outer circumferential surface of the roll 21*a*. The roll 21*a* accommodates the heater 21*c*. A driver (e.g., a motor) connected to the fixing roller 21 drives and rotates the fixing roller 21 counterclockwise in FIG. 2 in a rotation direction R3. The roll 21*a* is made of a tubular, thermal conductive metal having a predetermined mechanical strength, such as carbon steel (e.g., SC and STKM) and aluminum (Al), or the like. The outer layer 21*b* is constructed of an elastic layer and a coating layer coating an outer circumferential surface of the elastic layer.

The elastic layer is made of synthetic rubber such as silicone rubber (Q), fluoro rubber (FKM), or the like. The coating layer is made of a durable, thermal conductive material that prevents adhesion and stick of a material or a component that contacts the coating layer, that is, toner of the toner image on the recording medium P or a surface of a mold, facilitates separation of the toner image on the recording medium P from the coating layer, and enhances durability of the elastic layer. For example, the coating layer may be a fluoroplastic tube made of tetrafluoroethylene-perfluoroalkylvinylether copolymer (PFA) and coating the elastic layer. Alternatively, the coating layer may be produced by applying fluoroplastic coating made of PFA or polytetrafluoroethylene (PTFE). Yet alternatively, the coating layer may be a silicone rubber layer or a fluoro rubber layer coating the elastic layer.

A detailed description is now given of a construction of the heater 21*c*.

The heater 21*c* may be a heat source such as a halogen heater and a heater that generates Joule heat by an eddy current induced in a conductive layer incorporated in the roll 21*a* by a magnetic flux generated by an exciting coil. The Joule heat heats the outer layer 21*b* to a predetermined temperature. A temperature sensor (e.g., a thermistor) and a thermostat that prevents overheating of the fixing roller 21 are disposed opposite an outer circumferential surface of the fixing roller 21. A controller 40*b* (e.g., a processor), that is, a central processing unit (CPU) provided with a random-access memory (RAM) and a read-only memory (ROM), for example, is operatively connected to the heater 21*c*, the temperature sensor, and the thermostat. The controller 40*b* controls the heater 21*c* based on the temperature of the fixing roller 21 detected by the temperature sensor so as to adjust the temperature of the fixing roller 21 within a predetermined temperature range.

A detailed description is now given of a construction of the pressing roller 22.

The pressing roller 22, serving as a pressing rotary body, is rotatable in a rotation direction R4 and is constructed of a roll 22*a* and an outer layer 22*b* coating an outer circumferential surface of the roll 22*a*. The roll 22*a* is made of a tubular metal similar to that of the roll 21*a* of the fixing roller 21. Like the outer layer 21*b* of the fixing roller 21, the outer layer 22*b* of the pressing roller 22 is made of an elastic layer and a coating layer coating the elastic layer.

According to this exemplary embodiment, a pressurization assembly presses the pressing roller 22 against the fixing roller 21 to form the fixing nip N therebetween. Alternatively, the fixing device 20 may have configurations other than that of the fixing device 20 described above. For example, an endless belt serving as a fixing rotary body may be pressed against a roller or an endless belt serving as a pressing rotary body by a roller or a pad disposed inside the fixing rotary body, thus forming the fixing nip N between the fixing rotary body and the pressing rotary body. Further, the pressing rotary body may not press against the fixing rotary body but may merely contact the fixing rotary body.

A detailed description is now given of a construction of the separation unit 23.

The separation unit 23 includes a separation device 30 and a control device 40 operatively connected to the separation device 30 to control the separation device 30 to separate the recording medium P discharged from the fixing nip N from the fixing roller 21.

As shown in FIG. 4, the separation device 30 includes four separation assemblies 30A, 30B, 30C, and 30D independently movable from each other. The number of the separation assemblies incorporated in the separation device 30 is not limited to four. For example, the number of the separation assemblies may be arbitrary within a range of from two to about ten. If the separation device 30 is constructed of a single separation assembly, the single separation assembly may not separate the recording medium P from the fixing roller 21 precisely. Conversely, if the separation device 30 is constructed of too many separation assemblies, that is, eleven separation assemblies or more, the structure and control of the separation device 30 may be complex, increasing manufacturing costs of the separation device 30.

A detailed description is now given of a construction of the separation assembly 30A that is equivalent to a construction of each of the separation assemblies 30B, 30C, and 30D.

As shown in FIG. 2, the separation assembly 30A includes a separation pawl 31 serving as a separator disposed opposite the fixing roller 21; a separation roller pair 32 attached to the separation pawl 31; a shaft 33 to rotatably support the separation roller pair 32; a detent 34 to halt the separation pawl 31; a contact spring 35 serving as a contact biasing member anchored to the separation pawl 31 to bias the separation pawl 31 against the fixing roller 21, thus bringing the separation pawl 31 into contact with the fixing roller 21; an arm 36 separatably contacting the separation pawl 31 to separate the separation pawl 31 from the fixing roller 21; an isolation spring 37 anchored to the arm 36 to bias the arm 36 against the separation pawl 31, thus bringing the arm 36 into contact with the separation pawl 31; and a solenoid 38 serving as an actuator connected to and actuating the arm 36.

A detailed description is now given of a configuration of the separation pawl 31.

The separation pawl 31 is made of a material that facilitates separation of the recording medium P therefrom and sliding of the recording medium P thereover, such as PFA, polyetherketone (PEK), and polyetheretherketone (PEEK). Alternatively, the separation pawl 31 may be coated with a material that facilitates separation of the recording medium P therefrom and sliding of the recording medium P thereover such as PFA and Teflon®.

As shown in FIGS. 2 and 3, the separation pawl 31 is disposed downstream from the fixing nip N in the recording medium conveyance direction D1 and between the fixing roller 21 and the pressing roller 22 in a horizontal direction in FIGS. 2 and 3 orthogonal to the recording medium conveyance direction D1. The separation pawl 31 contacts and separates the recording medium P from the fixing roller 21. The separation pawl 31 is constructed of a wedge-shaped front 31*a;* a body 31*b* anchored with one end of the contact spring 35; and a top 31*c* to come into contact with the detent 34. A pivot f1 is interposed between the front 31*a* and the body 31*b*. The separation pawl 31 is pivotable about the pivot f1 so that the position of the separation pawl 31 is switched between an isolation position shown in FIG. 2 where the separation pawl 31 is isolated from the fixing roller 21 and a contact position shown in FIG. 3 where the separation pawl 31 is in contact with the fixing roller 21.

Figure 5:
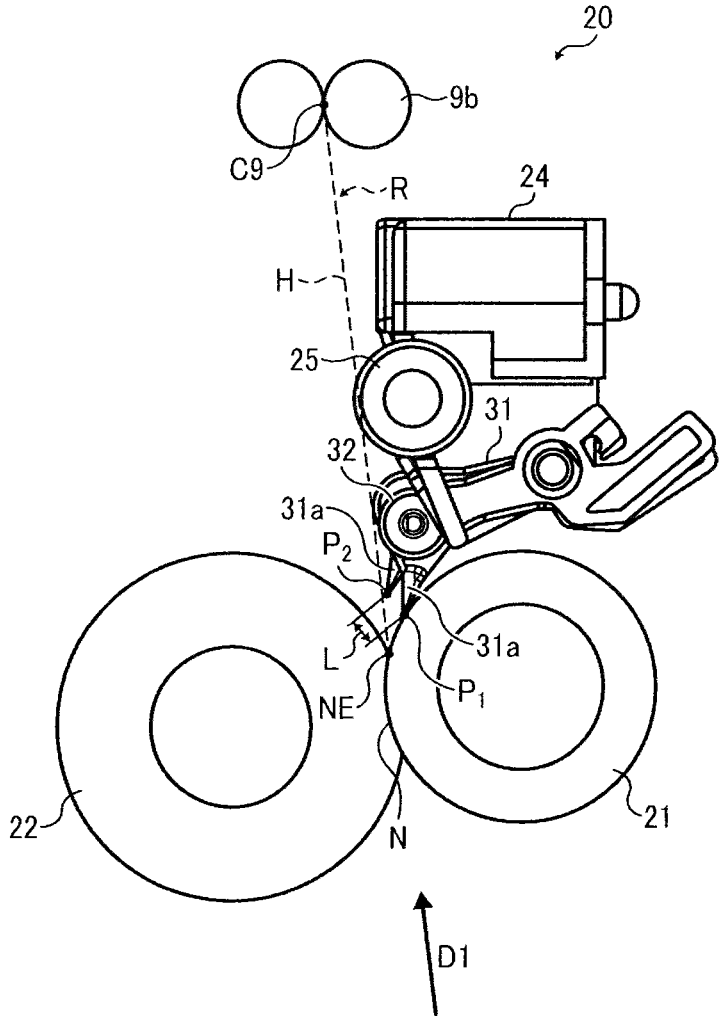
FIG. 5 is a partial vertical sectional view of the fixing device shown in FIG. 4 illustrating movement of a separation pawl incorporated therein.

FIG. 5 is a partial vertical sectional view of the fixing device 20 illustrating movement of the separation pawl 31. As shown in FIG. 5, a contact position P1 defines the front 31*a* of the separation pawl 31 in contact with the fixing roller 21. Conversely, an isolation position P2 defines the front 31*a* of the separation pawl 31 isolated from the fixing roller 21. Thus, a distance L is provided between the contact position P1 and the isolation position P2. The distance L defines a length of a locus of the separation pawl 31 moving from the contact position P1 where the separation pawl 31 is in contact with the fixing roller 21 to the isolation position P2 where the separation pawl 31 is isolated from the fixing roller 21, that is, a separation distance between the contact position P1 and the isolation position P2. The distance L is determined based on various conditions of the fixing device 20. For example, the distance L is about 2 mm.

A dotted line H defines a straight line starting from an exit NE of the fixing nip N and terminating at a contact C9 where two rollers of the output roller pair 9*b* contact each other. The dotted line H typically shows the conveyance path R. When the front 31*a* of the separation pawl 31 isolated from the fixing roller 21 is at the isolation position P2, the isolation position P2 is on the right of the dotted line H in FIG. 5. That is, the isolation position P2 is closer to the outer circumferential surface of the fixing roller 21 than the dotted line H is. Accordingly, the separation pawl 31 addresses problems described below.

If the isolation position P2 of the front 31*a* of the separation pawl 31 is on the left of the dotted line H, that is, closer to an outer circumferential surface of the pressing roller 22 than the dotted line H is, the front 31 a of the separation pawl 31 protrudes toward the pressing roller 22 and therefore intersects the conveyance path R. Accordingly, the front 31*a* of the separation pawl 31 obstructs conveyance of the recording medium P through the conveyance path R. If the front 31*a* of the separation pawl 31 intersecting the conveyance path R comes into contact with a soft recording medium P conveyed through the conveyance path R, the soft recording medium P is bent and therefore the front 31*a* of the separation pawl 31 does not scratch the soft recording medium P. However, the front 31*a* of the separation pawl 31 may obstruct movement of the soft recording medium P. Accordingly, it may take longer for the soft recording medium P to reach the output roller pair 9*b*. Further, an output sensor situated downstream from the separation pawl 31 in the recording medium conveyance direction D1 may not detect the soft recording medium P, resulting in jamming of the soft recording medium P. Conversely, if the front 31*a* of the separation pawl 31 intersecting the conveyance path R comes into contact with a rigid recording medium P conveyed through the conveyance path R, the front 31*a* of the separation pawl 31 contacts the rigid recording medium P longer, producing scratches and gloss streaks on the toner image on the rigid recording medium P.

Figure 6:
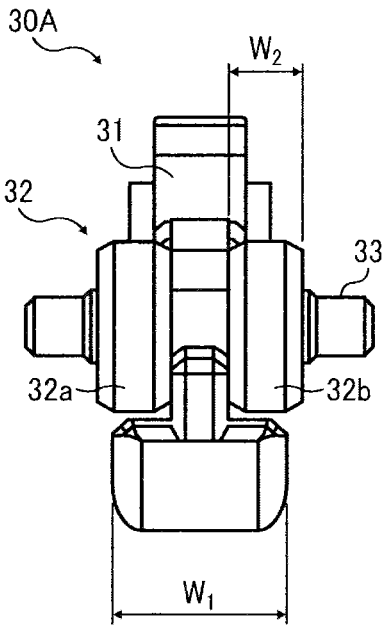
FIG. 6 is a front view of a separation assembly incorporated in the fixing device shown in FIG. 5.

With reference to FIG. 6, a description is provided of a construction of the separation roller pair 32.

FIG. 6 is a front view of the separation assembly 30A. As shown in FIG. 6, the separation roller pair 32 is constructed of a pair of rollers 32*a* and 32*b* rotatably supported by the shaft 33. Like the separation pawl 31, the pair of rollers 32*a* and 32*b* is made of a material that facilitates separation of the recording medium P therefrom and sliding of the recording medium P thereover. Alternatively, like the separation pawl 31, each of the rollers 32*a* and 32*b* may be coated with a material that facilitates separation of the recording medium P therefrom and sliding of the recording medium P thereover.

As shown in FIG. 6, the rollers 32*a* and 32*b* sandwich the separation pawl 31. Various conditions of the fixing device 20 depicted in FIG. 2 determine the size of the rollers 32*a* and 32*b* and the separation pawl 31 and pressure exerted from the front 31*a* of the separation pawl 31 to the fixing roller 21 when the front 31*a* of the separation pawl 31 contacts the fixing roller 21. For example, the pressure exerted from the front 31*a* of the separation pawl 31 to the fixing roller 21 is equivalent to a load in a range of from about 4 g to about 6 g. The pressure exerted from the front 31*a* of the separation pawl 31 to the fixing roller 21 is great enough to separate the recording medium P from the fixing roller 21. However, if the pressure exerted from the front 31*a* of the separation pawl 31 to the fixing roller 21 is too great, the front 31*a* of the separation pawl 31 may cause abrasion of the outer layer 21*b* of the fixing roller 21. Accordingly, abrasion of the outer layer 21*b* may damage the toner image on the recording medium P as the recording medium P slides over the outer layer 21*b*, thus producing gloss streaks on the toner image on the recording medium P. Conversely, if the pressure exerted from the front 31*a* of the separation pawl 31 to the fixing roller 21 is too small, the separation pawl 31 may not separate the recording medium P from the fixing roller 21 precisely.

As shown in FIG. 6, a width W1 of the front 31*a* of the separation pawl 31 in an axial direction of the fixing roller 21, although it varies depending on various conditions of the fixing device 20, is in a range of from about 3 mm to about 6 mm, for example. A width W2 of each of the rollers 32*a* and 32*b* is about 2.5 mm, for example. Since the front 31*a* of the separation pawl 31 comes into direct contact with the fixing roller 21, the front 31*a* of the separation pawl 31 may damage and cause abrasion of the outer layer 21*b* of the fixing roller 21, rendering the worn outer layer 21*b* to produce gloss streaks on the toner image on the recording medium P. To address this problem, it is preferable that the width W1 of the front 31*a* of the separation pawl 31 is small. However, if the width W1 of the front 31*a* of the separation pawl 31 is too small, the front 31*a* of the separation pawl 31 pressing against the fixing roller 21 may impose a greater load on the fixing roller 21, producing acute streaks on the outer layer 21*b* of the fixing roller 21 that may cause gloss streaks on the toner image on the recording medium P sliding thereover. Conversely, if the width W1 of the front 31*a* of the separation pawl 31 is too great, the front 31*a* of the separation pawl 31 may increase a resistance that obstructs rotation of the fixing roller 21, degrading conveyance of the recording medium P through the conveyance path R.

Figure 7:
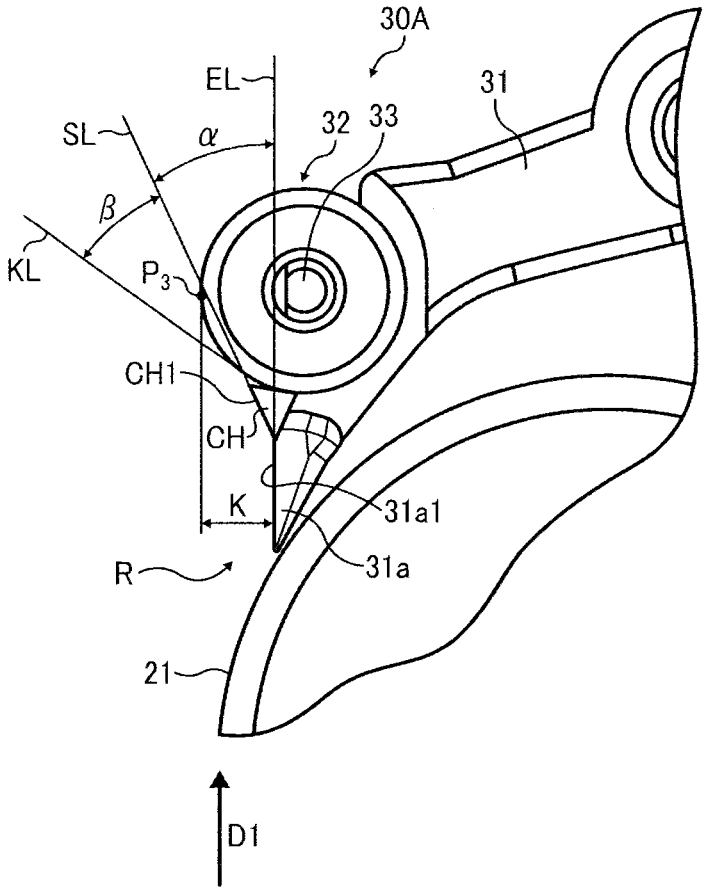
FIG. 7 is a partial vertical sectional view of the separation assembly shown in FIG. 6.

FIG. 7 is a partial vertical sectional view of the separation assembly 30A and the fixing roller 21. As shown in FIG. 7, the front 31*a* of the separation pawl 31 has an outer face 31*a*1 facing the conveyance path R. An elongation EL defines a straight line extending from the outer face 31*a*1 of the front 31*a* of the separation pawl 31 along the outer face 31*a*1 in cross-section. A projection point P3 of the separation roller pair 32 on the left of the elongation EL defines a part of the separation roller pair 32 that projects farthest from the shaft 33 toward the conveyance path R. A projection distance K defines a distance between the elongation EL and the projection point P3 in cross-section, that is, a direction substantially orthogonal to the recording medium conveyance direction D1. Thus, the separation roller pair 32 projects from the elongation EL by the projection distance K. A triangular junction CH in cross-section is interposed between the front 31*a* of the separation pawl 31 and the separation roller pair 32 in the recording medium conveyance direction D1. The junction CH has an outer face CH1 facing the conveyance path R. An elongation SL defines a straight line extending from the outer face CH1 of the junction CH along the outer face CH1 in cross-section. The elongation EL and the elongation SL form an angle $\alpha$. A tangent KL defines a straight line tangent to the separation roller pair 32. The elongation SL and the tangent KL form an angle $\beta$.

Various conditions of the fixing device 20 determine the projection distance K and the angles $\alpha$ and $\beta$. For example, the projection distance K is about 2 mm. The angle $\alpha$ is about 23 degrees. The angle $\beta$ is about 29 degrees. The junction CH facilitates conveyance of the recording medium P from the separation pawl 31 to the separation roller pair 32. If the junction CH is eliminated, the separation pawl 31 and the separation roller pair 32 form a greater, combined angle of the angles α and β. Accordingly, the recording medium P may strike the separation roller pair 32 and may be jammed.

Each of the angles α and β formed by the separation pawl 31, the junction CH, and the separation roller pair 32 to facilitate conveyance of the recording medium P from the separation pawl 31 to the separation roller pair 32 is not greater than about 30 degrees, thus preventing formation of a faulty toner image on the recording medium P and jamming of the recording medium P. According to this exemplary embodiment, the angle a formed between the elongation EL and the elongation SL is smaller than about 30 degrees. Similarly, the angle β formed between the elongation SL and the tangent KL is smaller than about 30 degrees.

If the projection distance K defining an amount of projection of the separation roller pair 32 from the separation pawl 31 is greater, as plain paper, thin paper having a paper weight not greater than about 70 g/m$^2$, or soft paper is used as a recording medium P, the separation roller pair 32 separates the recording medium P from the separation pawl 31 readily, preventing the separation pawl 31 from scratching the recording medium P. Conversely, if the projection distance K is greater, as thick paper having a paper weight not smaller than about 150 g/m$^2$ or rigid paper is used as a recording medium P, such recording medium P slides over the separation roller pair 32 with an increased friction therebetween. Accordingly, the separation roller pair 32 may scratch the recording medium P. To address this circumstance, the projection distance K is determined based on results of an experiment that examines scratches produced on thin paper and thick paper by the separation pawl 31 and the separation roller pair 32. Various conditions of the fixing device 20 determine the projection distance K. However, the projection distance K is about 2 mm, for example, to facilitate separation of the recording medium P from the separation pawl 31 precisely.

A description is now given of a configuration of the shaft 33.

As shown in FIG. 2, the shaft 33 is interposed between the front 31*a* of the separation pawl 31 and the pivot f1 in a direction substantially orthogonal to the recording medium conveyance direction D1. As shown in FIG. 6, the shaft 33 is supported by the separation pawl 31 at a center of the shaft 33 in the axial direction of the fixing roller 21. One end of the shaft 33 in the axial direction of the fixing roller 21 supports the roller 32*a;* another end of the shaft 33 in the axial direction of the fixing roller 21 supports the roller 32*b*.

A description is provided of a configuration of the detent 34.

As shown in FIG. 2, the detent 34 is interposed between the top 31*c* of the separation pawl 31 and the body 3 lb of the separation pawl 31 anchored with one end of the contact spring 35. The detent 34 restricts movement of the separation pawl 31 pivotable about the pivot f1 in a direction in which the separation pawl 31 separates from the fixing roller 21.

A description is now given of a configuration of the contact spring 35.

As shown in FIG. 2, the contact spring 35 is a tension coil spring. One end of the contact spring 35 is anchored to the body 31*b* of the separation pawl 31; another end of the contact spring 35 is anchored to or mounted on a housing or a frame of the fixing device 20. As shown in FIG. 3, the contact spring 35 biases the separation pawl 31 against the fixing roller 21 such that the front 31*a* of the separation pawl 31 contacts the fixing roller 21 with predetermined pressure therebetween. Thus, a rotation moment M1 about the pivot f1 is produced in the separation pawl 31.

With reference to FIG. 2, a description is provided of a configuration of the arm 36.

The arm 36 is made of light, heat-resistant, durable resin having a predetermined mechanical strength such as polyphenylene sulfide (PPS) and PEK. According to this exemplary embodiment, a pivot f2 about which the arm 36 pivots is manufactured separately from other section of the arm 36 so that the pivot f2 is made of SUS stainless steel that prevents bending of the arm 36 throughout a longitudinal direction thereof parallel to the axial direction of the fixing roller 21. Alternatively, the arm 36 may be made of a material selected in view of the size of the fixing device 20 and pressure exerted to the separation unit 23.

The arm 36 includes an elongate link constructed of a body 36*b* anchored with one end of the isolation spring 37 and a pressing portion 36*a* disposed opposite the body 36*b* via the pivot f2 and separatably contacting the body 31*b* of the separation pawl 31. The pivot f2 is interposed between the pressing portion 36*a* and the body 36*b*. Thus, the arm 36 is pivotable about the pivot f2.

A detailed description is now given of a configuration of the isolation spring 37.

Like the contact spring 35, the isolation spring 37 is a tension coil spring. One end of the isolation spring 37 is anchored to the body 36*b* of the arm 36; another end of the isolation spring 37 is anchored to or mounted on the housing or the frame of the fixing device 20. As shown in FIG. 2, the isolation spring 37 biases the arm 36 against the body 31*b* of the separation pawl 31 so that the front 31*a* of the separation pawl 31 is isolated from the fixing roller 21. As the isolation spring 37 produces a rotation moment M3 about the pivot f2 in the arm 36 that presses the pressing portion 36*a* of the arm 36 against the body 31*b* of the separation pawl 31, a rotation moment M2 is produced in the separation pawl 31 in a direction counter to the direction of the rotation moment M1. The rotation moment M2 is greater than the rotation moment M1. Accordingly, a tension placed on the body 36*b* of the arm 36 by the isolation spring 37 isolates the front 31*a* of the separation pawl 31 from the fixing roller 21.

According to this exemplary embodiment, a tension coil spring is used as the isolation spring 37. Alternatively, other mechanisms may be employed according to various conditions of the fixing device 20 such as installation space and manufacturing costs of the fixing device 20. For example, a compression coil spring may press the pressing portion 36*a* of the arm 36 to produce the rotation moment M3 about the pivot f2. Yet alternatively, other linkages may be employed.

A detailed description is now given of a configuration of the solenoid 38.

The solenoid 38 is constructed of a body 38*a* that accommodates a coil and a plunger 38*b* that protrudes from and retracts into the coil. The solenoid 38 is electrically connected to and actuated by the control device 40. As the coil incorporated in the body 38*a* is supplied with power according to an instruction from the control device 40, the coil is excited and the plunger 38*b* is retracted into the body 38*a*.

The plunger 38*b* is constructed of a base connected to and retracted by the coil inside the body 38*a* and a front coupled to the body 36*b* of the arm 36 that is anchored with one end of the isolation spring 37. As the plunger 38*b* is retracted into the body 38*a* by the coil, the plunger 38*b* pulls the body 36*b* of the arm 36 toward the body 38*a*. As the body 36*b* of the arm 36 is pulled downward, the arm 36 pivots about the pivot f2, producing a rotation moment M4 that is counter to and greater than the rotation moment M3 as shown in FIG. 3.

The rotation moment M4 separates the pressing portion 36*a* of the arm 36 from the body 31*b* of the separation pawl 31. Accordingly, the rotation moment M1 about the pivot f1 produced by a tension from the contact spring 35 brings the front 31*a* of the separation pawl 31 into contact with the fixing roller 21 with predetermined pressure therebetween. After the front 31*a* of the separation pawl 31 comes into contact with the fixing roller 21, the arm 36 pivots about the pivot f2 counterclockwise further until the arm 36 is isolated from the separation pawl 31 completely and comes to a halt. Accordingly, the front 31*a* of the separation pawl 31 contacts the outer circumferential surface of the fixing roller 21 with desired pressure therebetween by the tension from the contact spring 35 only. Thereafter, as power supply to the solenoid 38 is interrupted, the body 38*a* of the solenoid 38 no longer retracts the plunger 38*b* into the body 38*a*. Accordingly, a tension from the isolation spring 37 placed on the body 36*b* of the arm 36 presses the pressing portion 36*a* of the arm 36 against the body 31*b* of the separation pawl 31. Consequently, the separation pawl 31 pivots about the pivot f1 counterclockwise in FIG. 2 against the tension from the contact spring 35, isolating the front 31*a* of the separation pawl 31 from the outer circumferential surface of the fixing roller 21 as shown in FIG. 2.

Figure 8:
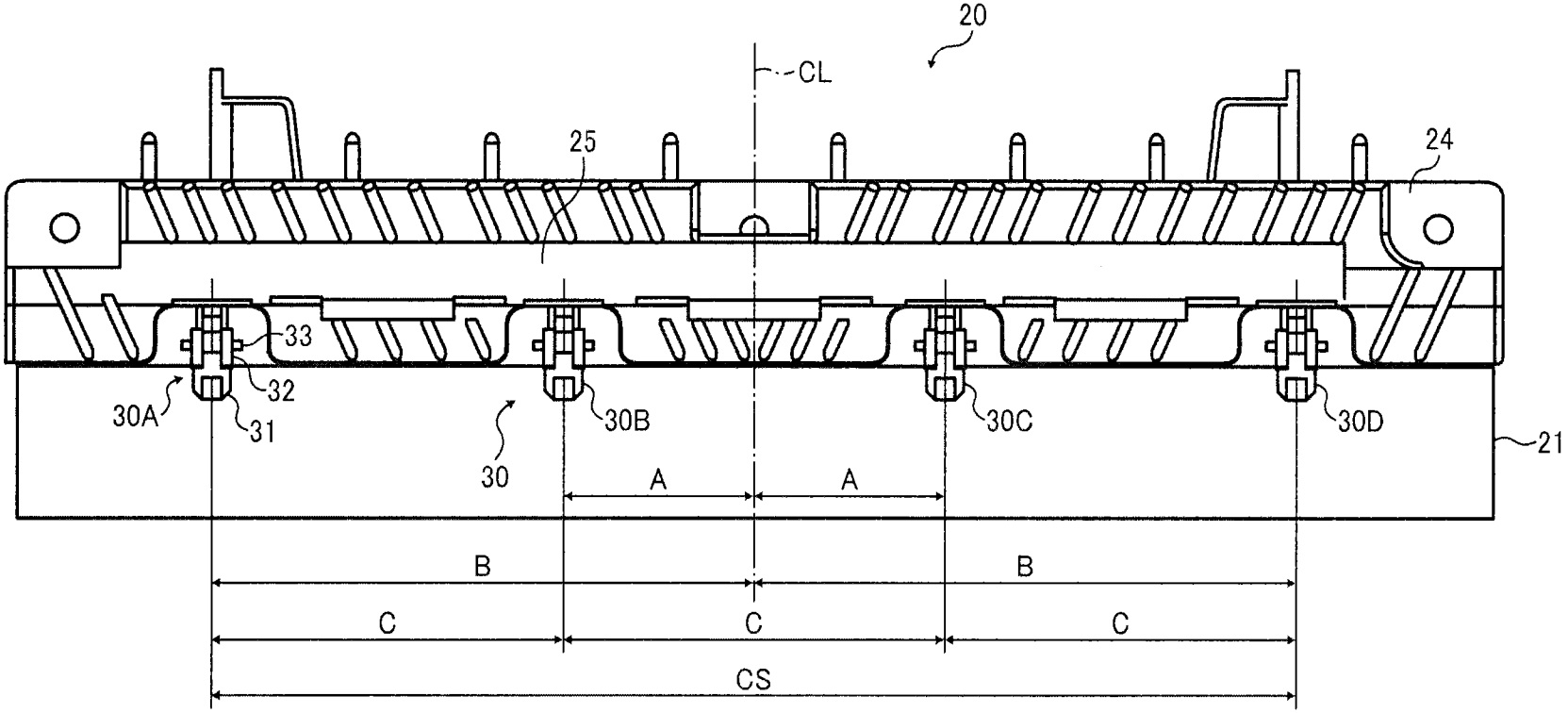
FIG. 8 is a partial front view of the fixing device shown in FIG. 4.

With reference to FIG. 8, a description is provided of a configuration of the separation assemblies 30A, 30B, 30C, and 30D.

FIG. 8 is a partial front view of the fixing device 20. Each of the separation assemblies 30B, 30C, and 30D has a construction equivalent to that of the separation assembly 30A shown in FIGS. 6 and 7. The separation assemblies 30A, 30B, 30C, and 30D are disposed opposite the fixing roller 21 as shown in FIG. 8. The separation assemblies 30A, 30B, 30C, and 30D are disposed opposite a conveyance span CS on the fixing roller 21 where the recording medium P is conveyed. For example, the separation assemblies 30B and 30C are spaced apart from a center line CL by an interval A in the axial direction of the fixing roller 21. The separation assemblies 30A and 30D are spaced apart from the center line CL by an interval B in the axial direction of the fixing roller 21.

The separation assemblies 30B and 30C are disposed opposite the conveyance span CS on the fixing roller 21. The separation assemblies 30A and 30D are partially disposed opposite the conveyance span CS on the fixing roller 21. That is, the separation assemblies 30A and 30D are partially disposed outboard from the conveyance span CS in the axial direction of the fixing roller 21. An interval C between the separation assembly 30A serving as a first lateral end separation assembly disposed opposite one lateral end of the fixing roller 21 in the axial direction thereof and the separation assembly 30B serving as a center separation assembly disposed opposite a center of the fixing roller 21 in the axial direction thereof is identical to an interval C between the separation assembly 30D serving as a second lateral end separation assembly disposed opposite another lateral end of the fixing roller 21 in the axial direction thereof and the separation assembly 30C serving as a center separation assembly disposed opposite the center of the fixing roller 21 in the axial direction thereof. That is, the identical interval C is provided between the adjacent separation assemblies 30A and 30B, between the adjacent separation assemblies 30B and 30C, and between the adjacent separation assemblies 30C and 30D. The separation assemblies 30A and 30B and the separation assemblies 30C and 30D are symmetric with respect to the center line CL. The symmetry of the separation assemblies 30A, 30B, 30C, and 30D with respect to the center line CL in the conveyance span CS on the fixing roller 21 renders deformation of the recording medium P discharged from the fixing nip N to be symmetric with respect to the center line CL, preventing dog-ear and jamming of the recording medium P and therefore conveying the recording medium P precisely.

The identical interval C provided between the adjacent separation assemblies 30A and 30B, between the adjacent separation assemblies 30B and 30C, and between the adjacent separation assemblies 30C and 30D renders the separation assemblies 30A, 30B, 30C, and 30D to exert uniform pressure to the fixing roller 21 to separate the recording medium P from the fixing roller 21, preventing concentration of load imposed on a particular part on the fixing roller 21 and thereby preventing damage to the fixing roller 21. According to this exemplary embodiment, the separation assemblies 30A and 30B and the separation assemblies 30C and 30D are symmetric with respect to the center line CL with the identical interval C between the adjacent separation assemblies 30A and 30B, between the adjacent separation assemblies 30B and 30C, and between the adjacent separation assemblies 30C and 30D. Alternatively, a slight positional error and variation in the intervals A, B, and C may be allowed according to various conditions of the fixing device 20.

The separation assemblies 30A, 30B, 30C, and 30D have the configuration described above that allows them to move independently from each other according to an instruction from the control device 40.

A description is provided of four examples of movement of the separation assemblies 30A, 30B, 30C, and 30D.

As a first example, at least one of the four separation pawls 31 of the four separation assemblies 30A, 30B, 30C, and 30D contacts the fixing roller 21 while the other separation pawls 31 of the separation assemblies 30A, 30B, 30C, and 30D are isolated from the fixing roller 21. Since at least one of the four separation pawls 31 of the four separation assemblies 30A, 30B, 30C, and 30D contacts the fixing roller 21, it separates the recording medium P from the fixing roller 21 by suppressing damage to the fixing roller 21 that may arise as two or more of the separation pawls 31 of the separation assemblies 30A, 30B, 30C, and 30D contact the fixing roller 21.

As a second example, the controller 40*b* selectively controls one or more of the separation assemblies 30A, 30B, 30C, and 30D to come into contact with the fixing roller 21 according to the type of the recording medium P (e.g., thin paper or thick paper) or the size of the recording medium P (e.g., A4 size or B5 size). That is, the separation pawl 31 of one or more of the separation assemblies 30A, 30B, 30C, and 30D selectively contacts the fixing roller 21 according to the type or the size of the recording medium P, thus separating the recording medium P from the fixing roller 21 effectively. For example, the controller 40*b* determines the type and the size of the recording medium P based on image data sent from the external device.

As a third example, the separation assemblies 30A, 30B, 30C, and 30D alternately contact the fixing roller 21. The controller 40*b* performs a first control of controlling the solenoid 38 of a first separation assembly (e.g., the separation assemblies 30A and 30C) to separate the arm 36 from the separation pawl 31 while controlling the solenoid 38 of a second separation assembly (e.g., the separation assemblies 30B and 30D) to bring the arm 36 into contact with the separation pawl 31 and a second control of controlling the solenoid 38 of the first separation assembly to bring the arm 36 into contact with the separation pawl 31 while controlling the solenoid 38 of the second separation assembly to separate the arm 36 from the separation pawl 31. The controller 40*b* performs the first control and the second control alternately. That is, the separation assemblies 30A and 30C contact the fixing roller 21 while the separation assemblies 30B and 30D are isolated from the fixing roller 21 or the separation assemblies 30A and 30C are isolated from the fixing roller 21 while the separation assemblies 30B and 30D contact the fixing roller 21. Accordingly, the separation assemblies 30A, 30B, 30C, and 30D come into contact with and isolation from the fixing roller 21 alternately, thus separating the recording medium P from the fixing roller 21 effectively.

As a fourth example, a center separation assembly (e.g., the separation assemblies 30B and 30C) disposed opposite a center of the fixing roller 21 in the axial direction thereof is sandwiched between a plurality of lateral end separation assemblies (e.g., the separation assemblies 30A and 30D) in the axial direction of the fixing roller 21. The center separation assembly contacts the fixing roller 21 constantly. For example, the separation assemblies 30B and 30C disposed opposite the center of the fixing roller 21 in the axial direction thereof constantly contact the fixing roller 21. Conversely, the separation assemblies 30A and 30D disposed opposite both lateral ends of the fixing roller 21 in the axial direction thereof, respectively, are in contact with or isolation from the fixing roller 21. Accordingly, the separation assemblies 30A and 30D selectively come into contact with the fixing roller 21, thus separating the recording medium P from the fixing roller 21 effectively.

With reference to FIG. 2, a detailed description is now given of a configuration of the control device 40.

As shown in FIG. 2, the control device 40 is constructed of a drive circuit 40*a* operatively connected to the solenoid 38; the controller 40*b* operatively connected to the drive circuit 40*a;* and a recording medium sensor 40*c* operatively connected to the controller 40*b* and detecting the recording medium P conveyed toward the fixing nip N.

The drive circuit 40*a* is a known circuit that actuates the solenoid 38 by an instruction from the controller 40*b*. The drive circuit 40*a* excites the coil inside the body 38*a* of the solenoid 38 by supplying power thereto. Conversely, the drive circuit 40*a* does not excite the coil by interrupting power supply thereto.

The controller 40*b* is constructed of an input-output (I/O) port that sends and receives data to and from a peripheral device and the CPU that performs data processing and controls the peripheral device. The controller 40*b* actuates the drive circuit 40*a* based on a detection signal sent from the recording medium sensor 40*c* upon detection of the recording medium P.

A detailed description is now given of a configuration of the recording medium sensor 40*c*.

As shown in FIG. 2, the recording medium sensor 40*c* includes a feeler 40*k* disposed upstream from the fixing nip N in the recording medium conveyance direction D1, that is, situated below the fixing nip N in FIG. 2. The feeler 40*k* is supported by the body 2 depicted in FIG. 1 such that the feeler 40*k* is pivotable about a pivot f3. The recording medium sensor 40*c* further includes a detent. For example, the feeler 40*k* intersects the conveyance path R through which the recording medium P is conveyed toward the fixing nip N. As the recording medium P conveyed through the conveyance path R comes into contact with the feeler 40*k*, the recording medium P rotates the feeler 40*k* about the pivot 13 counterclockwise as shown in FIG. 3. Thus, the recording medium sensor 40*c* detects passage of the recording medium P through the feeler 40*k*. After the recording medium P passes through the recording medium sensor 40*c*, the feeler 40*k* returns to the default position shown in FIG. 2 by its own weight or resiliency of a torsion coil spring. For example, the feeler 40*k* comes into contact with the detent and halts at the default position shown in FIG. 2.

The feeler 40*k* is located at a position in proximity to a center of the conveyance path R in a width direction thereof orthogonal to the recording medium conveyance direction D1, thus preventing the recording medium P from being skewed by contact with the feeler 40*k*. Such location of the feeler 40*k* facilitates smooth conveyance of the recording medium P that prevents creasing of the recording medium P and warping of a toner image on the recording medium P, enhancing reliability in conveyance of the recording medium P.

According to this exemplary embodiment, the recording medium sensor 40*c* is a contact sensor that detects the recording medium P by contacting it. Alternatively, the recording medium sensor 40*c* may be a contactless sensor that detects the recording medium P without contacting it. For example, the contactless sensor may be a reflective or transmission optical sensor. The contactless sensor does not skew the recording medium P conveyed through the conveyance path R. Further, a jam sensor for detecting a jammed recording medium P may be located upstream from the fixing nip N in the recording medium conveyance direction D1. In this case, such jam sensor may also serve as the recording medium sensor 40*c*.

A detailed description is now given of a configuration of the exit guide 24.

As shown in FIG. 4, the exit guide 24 is disposed downstream from the separation device 30 in the recording medium conveyance direction D1 and substantially surrounds the separation device 30. The exit guide 24 guides the recording medium P discharged from the fixing nip N toward the output roller pair 9*b* depicted in FIG. 1. The exit guide 24 may be manufactured into a lightweight complex made of a heat-resistant material such as polyethylene terephthalate (PET) containing glass fiber.

A front of the exit guide 24 is spaced apart from the separation pawl 31 and the fixing nip N to avoid contact with the fixing roller 21 and resultant damage to the fixing roller 21. Thus, a predetermined interval is produced between the front of the exit guide 24 and the outer circumferential surface of the fixing roller 21.

If the front of the exit guide 24 is disposed closer to the fixing nip N than the separation pawl 31 or as close to the fixing nip N as the separation pawl 31, the recording medium P may enter the interval between the front of the exit guide 24 and the fixing roller 21, producing dog-ear and jamming of the recording medium P. This may happen while the separation device 30 is separating the recording medium P from the fixing roller 21 and therefore the recording medium P is not isolated from the fixing roller 21 sufficiently, that is, while the separation pawls 31 of the separation device 30 separate a section of the recording medium P passing in proximity to the separation pawls 31 from the fixing roller 21 but another section of the recording medium P passing through an interval between the adjacent separation pawls 31 in the axial direction of the fixing roller 21 still adheres to the fixing roller 21. To address this problem, the front of the exit guide 24 is disposed opposite the outer circumferential surface of the fixing roller 21 with a predetermined interval therebetween. For example, the front of the exit guide 24 is spaced apart from the fixing nip N further than the separation pawl 31.

A detailed description is now given of a configuration of the guide roller 25.

As shown in FIG. 4, the guide roller 25 is rotatably supported by the exit guide 24. The guide roller 25 is a tube having a long length equivalent to the conveyance span CS depicted in FIG. 8 on the fixing roller 21 where the recording medium P is conveyed. The guide roller 25 is made of a material having an increased mechanical strength such as aluminum and iron. A surface of the guide roller 25 is coated with a material that facilitates separation of the recording medium P therefrom and sliding of the recording medium P thereover, such as PFA and Teflon®.

Figure 9:
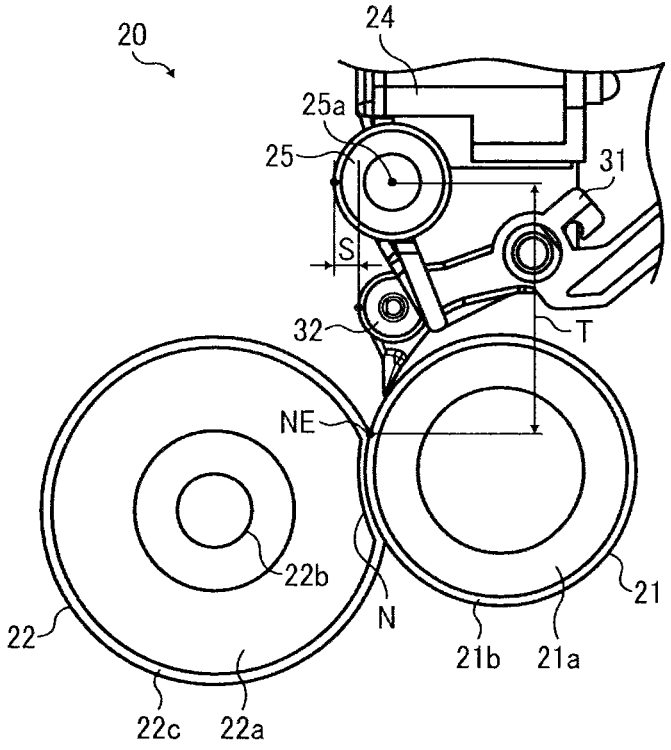
FIG. 9 is a partial vertical sectional view of the fixing device shown in FIG. 5 illustrating a guide roller incorporated therein.

FIG. 9 is a partial vertical sectional view of the fixing device 20. As shown in FIG. 9, a distance T defines a vertical distance from the exit NE of the fixing nip N to an axis 25*a* of the guide roller 25. For example, the distance T is about 20 mm. A projection distance S defines a horizontal distance from an outer circumferential surface of the separation roller pair 32 to an outer circumferential surface of the guide roller 25. For example, the projection distance S is about 2 mm.

The greater the projection distance S is, the more the guide roller 25 suppresses scratches on the toner image on the recording medium P caused by the separation pawl 31 and the separation roller pair 32 that may result in a faulty toner image having gloss streaks. However, as the recording medium P is heated while it passes through the fixing nip N, moisture contained in the recording medium P is evaporated into steam. If the guide roller 25 has the greater projection distance S, as the recording medium P is discharged from the fixing nip N, the steam is released from the recording medium P and is subject to adhesion to the guide roller 25 situated above the fixing nip N at a projection of the guide roller 25 having the greater projection distance S. The steam adhered to the projection of the guide roller 25 may move to the recording medium P as water droplets. As the recording medium P is dried, the water droplets may leave marks on the recording medium P. Further, during duplex printing for forming toner images on both sides of the recording medium P, water droplets adhered to the recording medium P may degrade a section on the recording medium P that bears the water droplets. Accordingly, as the recording medium P returns to the secondary transfer nip to receive a toner image from the transfer belt 5*a* on a back side of the recording medium P, the toner image may not be secondarily transferred from the transfer belt 5*a* onto the recording medium P properly, resulting formation of a chipped toner image on the recording medium P.

To address this circumstance, the distance T is reduced. That is, the smaller the distance T is, the closer the guide roller 25 is to the exit NE of the fixing nip N. Accordingly, the separation pawl 31 and the separation roller pair 32 suppress formation of a faulty toner image having scratches and gloss streaks on the recording medium P. Additionally, the closer the guide roller 25 is to the exit NE of the fixing nip N, the smaller the projection distance S of the guide roller 25 is. Accordingly, the smaller projection distance S of the guide roller 25 reduces adhesion of steam from the heated recording medium P to the projection of the guide roller 25. Thus, in view of a relation between the projection distance S and the distance T, the guide roller 25, the fixing roller 21, the pressing roller 22, the separation pawl 31, and the separation roller pair 32 are positioned with each other precisely.

With reference to FIGS. 1, 2, and 5, a description is provided of an image forming operation of the image forming apparatus 1 having the structure described above to form a color toner image on a recording medium P.

As a print job starts, a driver drives and rotates the photoconductive drums 4*d* of the process units 4Y, 4C, 4M, and 4K, respectively, clockwise in FIG. 1 in the rotation direction R1. The charging rollers 4*r* uniformly charge the outer circumferential surface of the respective photoconductive drums 4*d* at a predetermined polarity. The exposure device 3 emits laser beams onto the charged outer circumferential surface of the respective photoconductive drums 4*d* according to yellow, cyan, magenta, and black image data constituting color image data sent from the external device, respectively, thus forming electrostatic latent images thereon. The development devices 4*g* supply yellow, cyan, magenta, and black toners to the electrostatic latent images formed on the photoconductive drums 4*d*, visualizing the electrostatic latent images into yellow, cyan, magenta, and black toner images, respectively.

As the driving roller 5*c* is driven and rotated counterclockwise in FIG. 1, the driving roller 5*c* drives and rotates the transfer belt 5*a* counterclockwise in FIG. 1 in the rotation direction R2. A power supply applies a constant voltage or a constant current control voltage having a polarity opposite a polarity of toner to the primary transfer rollers 5dY, 5dC, 5dM, and 5dK. Thus, a transfer electric field is created at the primary transfer nips formed between the primary transfer rollers 5dY, 5dC, 5dM, and 5dK and the photoconductive drums 4*d*, respectively. Accordingly, the yellow, cyan, magenta, and black toner images formed on the photoconductive drums 4*d*, respectively, are primarily transferred onto the transfer belt 5*a* successively by the transfer electric field created at the respective primary transfer nips, such that the yellow, cyan, magenta, and black toner images are superimposed on the same position on the transfer belt 5*a*. Consequently, a color toner image is formed on the transfer belt 5*a*.

After the primary transfer of the yellow, cyan, magenta, and black toner images onto the transfer belt 5*a*, the cleaning blade 4*b* removes residual toner failed to be transferred onto the transfer belt 5*a* and therefore remaining on the respective photoconductive drums 4*d* therefrom. Thereafter, the discharger removes residual charge from the respective photoconductive drums 4*d* by discharging. Thus, the potential on the outer circumferential surface of the respective photoconductive drums 4*d* is initialized so that the photoconductive drums 4*d* become ready for a next print job.

As the development devices 4*g* start visualizing the electrostatic latent images formed on the photoconductive drum 4*d* into the yellow, cyan, magenta, and black toner images, respectively, the feed roller 8*b* situated in the lower portion of the body 2 rotates counterclockwise in FIG. 1 to feed a recording medium P from the sheet tray 8*a* to the conveyance path R. As the recording medium P conveyed through the conveyance path R reaches the registration roller pair 11, the registration roller pair 11 feeds the recording medium P toward the secondary transfer nip formed between the secondary transfer roller 5*e* and the driving roller 5*c* at a time when the color toner image formed on the transfer belt 5*a* reaches the secondary transfer nip. The secondary transfer roller 5*e* is applied with a transfer voltage having a polarity opposite a polarity of the charged yellow, cyan, magenta, and black toners of the yellow, cyan, magenta, and black toner images constituting the color toner image formed on the transfer belt 5*a*, thus creating a transfer electric field at the secondary transfer nip.

Accordingly, the yellow, cyan, magenta, and black toner images constituting the color toner image are secondarily transferred from the transfer belt 5*a* onto the recording medium P collectively by the transfer electric field created at the secondary transfer nip. The recording medium P bearing the color toner image secondarily transferred from the transfer belt 5*a* is conveyed to the fixing device 20 where the fixing roller 21 and the pressing roller 22 apply heat and pressure to the recording medium P to fix the color toner image on the recording medium P. Thereafter, the recording medium P bearing the fixed color toner image is separated from the fixing roller 21 by the separation unit 23 and conveyed to the output roller pair 9*b* that discharges the recording medium P onto the output tray 9*a* of the sheet output 9. After the secondary transfer of the color toner image from the transfer belt 5*a* onto the recording medium P, the belt cleaner 6 removes residual toner failed to be transferred onto the recording medium P and therefore remaining on the transfer belt 5*a* therefrom. The removed toner is conveyed and collected into the waste toner container 7.

The above describes the image forming operation of the image forming apparatus 1 to form the color toner image on the recording medium P. Alternatively, the image forming apparatus 1 may form a monochrome toner image by using any one of the four process units 4Y, 4C, 4M, and 4K or may form a bicolor or tricolor toner image by using two or three of the process units 4Y, 4C, 4M, and 4K.

With reference to FIGS. 2 to 4, a description is provided of advantages of the fixing device 20 described above.

The fixing device 20 includes the fixing roller 21 accommodating the heater 21*c;* the pressing roller 22 pressed against the fixing roller 21 to form the fixing nip N therebetween; and the separation device 30 including the four separation assemblies 30A, 30B, 30C, and 30D aligned in the axial direction of the fixing roller 21 to separate the recording medium P discharged from the fixing nip N from the fixing roller 21. Each of the separation assemblies 30A, 30B, 30C, and 30D includes the separation pawl 31 separatably contacting the fixing roller 21; the contact spring 35 biasing the separation pawl 31 against the fixing roller 21; the arm 36 separatably contacting the separation pawl 31 to press the separation pawl 31 against a bias exerted from the contact spring 35 to the separation pawl 31; and the solenoid 38 to separate the arm 36 from the separation pawl 31. The control device 40 controls the solenoid 38 of at least one of the separation assemblies 30A, 30B, 30C, and 30D to bring the separation pawl 31 of the at least one of the separation assemblies 30A, 30B, 30C, and 30D into contact with the fixing roller 21.

Accordingly, the separation pawl 31 of the at least one of the separation assemblies 30A, 30B, 30C, and 30D prevents formation of a faulty toner image bearing scratches that may be produced as the four separation pawls 31 contact the recording medium P and prevents the recording medium P from being sandwiched between the separation pawl 31 and the fixing roller 21. The separation pawl 31 of the at least one of the four separation assemblies 30A, 30B, 30C, and 30D in contact with the fixing roller 21 prevents the recording medium P from entering between the separation pawl 31 and the fixing roller 21 and being wound around the fixing roller 21, thus preventing jamming of the recording medium P.

For example, the fixing device 20 addresses the circumstances below. If all of the four separation pawls 31 of the four separation assemblies 30A, 30B, 30C, and 30D are isolated from the fixing roller 21 while no recording medium P is conveyed through the fixing nip N, as multi feeding of a plurality of recording media P or jamming of a recording medium P during duplex printing occurs, the recording medium P may pass through the fixing nip N while no separation pawl 31 contacts the fixing roller 21. If this accidentally happens, the recording medium P may enter between the separation pawls 31 and the fixing roller 21 and may be wound around the fixing roller 21.

Since the controller 40*b* is capable of selectively controlling one of the four separation pawls 31 of the four separation assemblies 30A, 30B, 30C, and 30D to come into contact with the fixing roller 21, compared to a configuration in which the controller 40*b* controls all of the four separation pawls 31 to come into contact with the fixing roller 21, one of the four separation pawls 31 reduces abrasion marks on the fixing roller 21 that may be produced by the four separation pawls 31 when the useful life of the fixing roller 21 is about to end. Accordingly, even duration of the fixing roller 21 is about to end, the fixing roller 21 does not have abrasion marks that may form a faulty toner image on the recording medium P, for example, a toner image having scratches, gloss streaks, or variation in gloss.

The separation device 30 is constructed of the four separation assemblies 30A, 30B, 30C, and 30D that are actuated independently from each other. Accordingly, the separation assemblies 30A, 30B, 30C, and 30D are actuated according to four examples of movement that attain advantages described below.

As the first example, at least one of the four separation pawls 31 of the four separation assemblies 30A, 30B, 30C, and 30D contacts the fixing roller 21 while the other separation pawls 31 of the separation assemblies 30A, 30B, 30C, and 30D are isolated from the fixing roller 21. Since at least one of the four separation pawls 31 of the four separation assemblies 30A, 30B, 30C, and 30D contacts the fixing roller 21 constantly, it separates the recording medium P from the fixing roller 21 while suppressing damage to the fixing roller 21 that may arise as two or more of the separation pawls 31 of the separation assemblies 30A, 30B, 30C, and 30D contact the fixing roller 21.

As the second example, the controller 40*b* selectively controls one or more of the separation assemblies 30A, 30B, 30C, and 30D to come into contact with the fixing roller 21 according to the type of the recording medium P (e.g., thin paper or thick paper) or the size of the recording medium P (e.g., A4 size or B5 size). That is, the separation pawl 31 of one or more of the separation assemblies 30A, 30B, 30C, and 30D selectively contacts the fixing roller 21 according to the type or the size of the recording medium P, thus separating the recording medium P from the fixing roller 21 effectively.

As the third example, the separation assemblies 30A, 30B, 30C, and 30D alternately contact the fixing roller 21. For example, the separation assemblies 30A and 30C contact the fixing roller 21 while the separation assemblies 30B and 30D are isolated from the fixing roller 21 or the separation assemblies 30A and 30C are isolated from the fixing roller 21 while the separation assemblies 30B and 30D contact the fixing roller 21. Accordingly, the separation assemblies 30A, 30B, 30C, and 30D come into contact with and isolation from the fixing roller 21 alternately, thus separating the recording medium P from the fixing roller 21 effectively.

As the fourth example, the separation assemblies 30B and 30C disposed opposite the center of the fixing roller 21 in the axial direction thereof are in constant contact with the fixing roller 21. Conversely, the separation assemblies 30A and 30D disposed opposite both lateral ends of the fixing roller 21 in the axial direction thereof, respectively, are in contact with or isolation from the fixing roller 21. Accordingly, the separation assemblies 30A and 30D selectively come into contact with the fixing roller 21, thus separating the recording medium P from the fixing roller 21 effectively.

As shown in FIGS. 2 and 3, the fixing device 20 includes the fixing roller 21 serving as a fixing rotary body rotatable in the rotation direction R3 and accommodating the heater 21*c;* the pressing roller 22 serving as a pressing rotary body rotatable in the rotation direction R4 and contacting the fixing roller 21 to form the fixing nip N therebetween through which a recording medium P is conveyed; and the plurality of separation assemblies 30A, 30B, 30C, and 30D aligned in the axial direction of the fixing roller 21 to separate the recording medium P discharged from the fixing nip N from the fixing roller 21. Each of the separation assemblies 30A, 30B, 30C, and 30D includes the separation pawl 31 serving as a separator separatably contacting the outer circumferential surface of the fixing roller 21; the contact spring 35 serving as a contact biasing member to bias the separation pawl 31 against the fixing roller 21; the arm 36 separatably contacting the separation pawl 31 to isolate the separation pawl 31 from the fixing roller 21; and the solenoid 38 serving as an actuator connected to the arm 36 to separate the arm 36 from the separation pawl 31. The fixing device 20 further includes the controller 40*b* operatively connected to the solenoid 38 of each of the separation assemblies 30A, 30B, 30C, and 30D. The controller 40*b* controls the solenoid 38 of at least one of the separation assemblies 30A, 30B, 30C, and 30D to separate the arm 36 from the separation pawl 31 so as to bring the separation pawl 31 into contact with the fixing roller 21 by the contact spring 35.

Accordingly, the fixing device 20 incorporating the separation assemblies 30A, 30B, 30C, and 30D and the image forming apparatus 1 incorporating the fixing device 20 prevent formation of a faulty toner image bearing scratches that may be produced as the four separation pawls 31 contact the recording medium P and prevent the recording medium P from being sandwiched between the separation pawl 31 and the fixing roller 21.

According to the above-described exemplary embodiment, the fixing roller 21 is used as a fixing rotary body. Alternatively, a fixing belt, a fixing film, or the like may be used as a fixing rotary body. Further, according to the above-described exemplary embodiments, the pressing roller 22 is used as a pressing rotary body. Alternatively, a pressing belt, a pressing pad, or the like may be used as a pressing rotary body.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a fixing rotary body rotatable in a predetermined direction of rotation;

a pressing rotary body contacting the fixing rotary body to form a fixing nip therebetween through which a recording medium is conveyed;

a plurality of separation assemblies disposed opposite an outer circumferential surface of the fixing rotary body and aligned in an axial direction thereof to separate the recording medium discharged from the fixing nip from the fixing rotary body, each of the plurality of separation assemblies is independent from one another and each includes:

a separator separatably contacting the outer circumferential surface of the fixing rotary body;

a contact biasing member anchored to the separator to bias the separator against the fixing rotary body;

an arm separatably contacting the separator to isolate the separator from the fixing rotary body; and an actuator connected to the arm to separate the arm from the separator; and a controller operatively connected to the actuator of each of the plurality of separation assemblies to control the actuator of at least one of the plurality of separation assemblies to separate the arm from the separator so as to bring the separator into contact with the fixing rotary body by the contact biasing member, wherein the plurality of separation assemblies includes:

a first separation assembly; and a second separation assembly disposed adjacent to the first separation assembly, and wherein the controller performs a first control of controlling the actuator of the first separation assembly to separate the arm from the separator while controlling the actuator of the second separation assembly to bring the arm into contact with the separator and a second control of controlling the actuator of the first separation assembly to bring the arm into contact with the separator while controlling the actuator of the second separation assembly to separate the arm from the separator.

2. The fixing device according to claim 1, wherein the controller controls the actuator of the at least one of the plurality of separation assemblies to separate the arm from the separator based on a type and a size of the recording medium.

3. The fixing device according to claim 1, wherein the controller performs the first control and the second control alternately.

4. The fixing device according to claim 1, wherein the plurality of separation assemblies includes:

at least one center separation assembly disposed opposite a center of the fixing rotary body in the axial direction thereof; and a plurality of lateral end separation assemblies sandwiching the at least one center separation assembly in the axial direction of the fixing rotary body, and wherein the at least one center separation assembly contacts the fixing rotary body constantly.

5. The fixing device according to claim 4, wherein the plurality of lateral end separation assemblies includes:

a first lateral end separation assembly disposed opposite one lateral end of the fixing rotary body in the axial direction thereof; and a second lateral end separation assembly disposed opposite another lateral end of the fixing rotary body in the axial direction thereof, and wherein an interval between the first lateral end separation assembly and the at least one center separation assembly in the axial direction of the fixing rotary body is identical to an interval between the second lateral end separation assembly and the at least one center separation assembly in the axial direction of the fixing rotary body.

6. The fixing device according to claim 1, wherein each of the plurality of separation assemblies further includes a separation roller pair rotatably supported by the separator and the separator includes a front separatably contacting the outer circumferential surface of the fixing rotary body, and wherein the separation roller pair projects from the front of the separator by a predetermined projection distance in a direction substantially orthogonal to a recording medium conveyance direction.

7. The fixing device according to claim 6, wherein the predetermined projection distance is about 2 mm.

8. The fixing device according to claim 6, wherein each of the plurality of separation assemblies further includes a triangular junction interposed between the front of the separator and the separation roller pair in the recording medium conveyance direction, the junction projecting from the front of the separator by a distance smaller than the predetermined projection distance.

9. The fixing device according to claim 6, wherein the plurality of separation assemblies is aligned in the axial direction of the fixing rotary body over a conveyance span on the fixing rotary body where the recording medium is conveyed.

10. The fixing device according to claim 9, further comprising a guide roller disposed downstream from the plurality of separation assemblies in the recording medium conveyance direction and having a length equivalent to the conveyance span on the fixing rotary body.

11. The fixing device according to claim 10, wherein a horizontal distance of about 2 mm is provided from an outer circumferential surface of the separation roller pair to an outer circumferential surface of the guide roller.

12. The fixing device according to claim 11, wherein a vertical distance of about 20 mm is provided from an exit of the fixing nip to an axis of the guide roller.

13. The fixing device according to claim 1, wherein the fixing rotary body includes a fixing roller.

14. The fixing device according to claim 1, wherein the pressing rotary body includes a pressing roller.

15. The fixing device according to claim 1, wherein the separator includes a separation pawl.

16. The fixing device according to claim 1, wherein the contact biasing member includes a tension coil spring.

17. The fixing device according to claim 1, wherein the actuator includes a solenoid.

18. An image forming apparatus comprising the fixing device according to claim 1.

19. A fixing device comprising:

a fixing rotary body rotatable in a predetermined direction of rotation;

a pressing rotary body contacting the fixing rotary body to form a fixing nip therebetween through which a recording medium is conveyed;

a plurality of separation assemblies disposed opposite an outer circumferential surface of the fixing rotary body and aligned in an axial direction thereof to separate the recording medium discharged from the fixing nip from the fixing rotary body, each of the plurality of separation assemblies including:

a separator separatably contacting the outer circumferential surface of the fixing rotary body;

a contact biasing member anchored to the separator to bias the separator against the fixing rotary body;

an arm separatably contacting the separator to isolate the separator from the fixing rotary body; and an actuator connected to the arm to separate the arm from the separator; and a controller operatively connected to the actuator of each of the plurality of separation assemblies to control the actuator of at least one of the plurality of separation assemblies to separate the arm from the separator so as to bring the separator into contact with the fixing rotary body by the contact biasing member, wherein the plurality of separation assemblies includes:

a first separation assembly; and a second separation assembly disposed adjacent to the first separation assembly, wherein the controller performs a first control of controlling the actuator of the first separation assembly to separate the arm from the separator while controlling the actuator of the second separation assembly to bring the arm into contact with the separator and a second control of controlling the actuator of the first separation assembly to bring the arm into contact with the separator while controlling the actuator of the second separation assembly to separate the arm from the separator, and wherein the controller performs the first control and the second control alternately.

20. A fixing device comprising:

a fixing rotary body rotatable in a predetermined direction of rotation;

a pressing rotary body contacting the fixing rotary body to form a fixing nip therebetween through which a recording medium is conveyed;

a plurality of separation assemblies disposed opposite an outer circumferential surface of the fixing rotary body and aligned in an axial direction thereof to separate the recording medium discharged from the fixing nip from the fixing rotary body, each of the plurality of separation assemblies is independent from one another and each includes:

a pawl separatably contacting the outer circumferential surface of the fixing rotary body;

a spring anchored to the pawl to bias the pawl against the fixing rotary body;

an arm separatably contacting the pawl to isolate the pawl from the fixing rotary body; and an actuator connected to the arm to separate the arm from the pawl; and circuitry operatively connected to the actuator of each of the plurality of separation assemblies to control the actuator of at least one of the plurality of separation assemblies to separate the arm from the pawl so as to bring the pawl into contact with the fixing rotary body by the contact biasing member, wherein the plurality of separation assemblies includes:

a first separation assembly; and a second separation assembly disposed adjacent to the first separation assembly, and wherein the circuitry performs a first control of controlling the actuator of the first separation assembly to separate the arm from the separator while controlling the actuator of the second separation assembly to bring the arm into contact with the separator and a second control of controlling the actuator of the first separation assembly to bring the arm into contact with the separator while controlling the actuator of the second separation assembly to separate the arm from the separator.

* * * * *